US012571534B2

(12) United States Patent
Ma et al.

(10) Patent No.: US 12,571,534 B2
(45) Date of Patent: Mar. 10, 2026

(54) PNEUMATIC CONVEYING SYSTEM AND CIRCULATING FLUIDIZED BED BOILER

(71) Applicants: Taiyuan University of Technology, Taiyuan City (CN); SHANXI RESEARCH INSTITUTE OF HUAIROU LABORATORY, Taiyuan (CN)

(72) Inventors: Suxia Ma, Taiyuan City (CN); Jianwei Liu, Taiyuan City (CN); Chen Luo, Taiyuan City (CN); Zhongyuan Liu, Taiyuan City (CN); Zemin Yuan, Taiyuan City (CN); Gaowei Yan, Taiyuan City (CN); Guanjia Zhao, Taiyuan City (CN); Yuchuan Feng, Taiyuan City (CN); Jing Xu, Taiyuan City (CN); Jiajie Zhang, Taiyuan City (CN)

(73) Assignees: TAIYUAN UNIVERSITY OF TECHNOLOGY, Taiyuan City (CN); SHANXI RESEARCH INSTITUTE OF HUAIROU LABORATORY, Taiyuan (CN)

( * ) Notice: Subject to any disclaimer, the term of this patent is extended or adjusted under 35 U.S.C. 154(b) by 0 days.

(21) Appl. No.: 19/243,279

(22) Filed: Jun. 19, 2025

(65) Prior Publication Data

US 2025/0383085 A1 Dec. 18, 2025

Related U.S. Application Data

(63) Continuation of application No. PCT/CN2025/079456, filed on Feb. 27, 2025.

(30) Foreign Application Priority Data

Jun. 12, 2024 (CN) ..... 202410749134.7

(51) Int. Cl.
*F23K 3/02* (2006.01)

(52) U.S. Cl.
CPC ..... *F23K 3/02* (2013.01); *F23K 2203/008* (2013.01); *F23K 2203/201* (2013.01)

(58) Field of Classification Search
CPC . F23K 3/02; F23K 2203/008; F23K 2203/201
See application file for complete search history.

(56) References Cited

U.S. PATENT DOCUMENTS 1,412,642 A * 4/1922 Amsler ..... F23K 3/00 406/106
1,562,411 A * 11/1925 Caracristi ..... F23K 3/00 110/106

(Continued)

FOREIGN PATENT DOCUMENTS

CN 102679329 A 9/2012
CN 104613752 A 5/2015

(Continued)

OTHER PUBLICATIONS

First Office Action in Corresponding Chinese Application No. 202410749134.7, dated Jul. 19, 2024; 12 pgs.

(Continued)

*Primary Examiner* — Michael G Hoang
*Assistant Examiner* — Logan P Jones
(74) *Attorney, Agent, or Firm* — HAUPTMAN HAM, LLP

(57) ABSTRACT

The present invention relates to a pneumatic conveying system and a circulating fluidized bed (CFB) boiler, belonging to the technical field of CFB boilers. The system comprises an air compressor that supplies compressed air to an air-powder mixer, a coal powder bin that stores coal powder and feeds it into the air-powder mixer via a powder feeder, and the air-powder mixer, which blends the com- (Continued)

pressed air and coal powder to output an air-powder mixture. The outlet of the air-powder mixer is connected to a main conveying pipe, which branches via a distributor to multiple conveying pipes. These conveying pipes are connected to secondary air pipes on the front, rear, and side walls of the CFB boiler in a sleeve-type manner, delivering the air-powder mixture into the furnace chamber. The invention enhances the load change rate of CFB units from the current 1% Pe/min to over 3% Pe/min, reduces the ignition restart temperature, extends the ignition hold time, and ensures safe and rapid load increase for CFB units.

2 Claims, 2 Drawing Sheets

(56) References Cited

U.S. PATENT DOCUMENTS 4,459,922 A * 7/1984 Chadshay ..... F23K 3/02 251/8
2007/0095260 A1* 5/2007 John ..... F23K 3/02 110/106
2014/0305356 A1 10/2014 D'Agostini et al.
2019/0154262 A1* 5/2019 Wu ..... F23G 5/027
2025/0122999 A1* 4/2025 Xiang ..... F23K 3/00

FOREIGN PATENT DOCUMENTS

CN 109539246 A 3/2019
CN 116557851 A 8/2023

OTHER PUBLICATIONS

Notification to Grant in Corresponding Chinese Application No. 202410749134.7, dated Aug. 29, 2024; 4 pgs.
Search Report in Corresponding Chinese Application No. 202410749134.7, dated Jul. 15, 2024; 6 pgs.
Second Office Action in Corresponding Chinese Application No. 202410749134.7, dated Aug. 3, 2024; 14 pgs.

* cited by examiner

PNEUMATIC CONVEYING SYSTEM AND CIRCULATING FLUIDIZED BED BOILER

RELATED APPLICATIONS

The present application is a Continuation of International Application No. PCT/CN2025/079456 filed Feb. 27, 2025, which claims priority from Chinese Application Number 202410749134.7 filed Jun. 12, 2024, the disclosures of which are hereby incorporated by reference herein in their entireties.

TECHNICAL FIELD

The invention pertains to circulating fluidized bed (CFB) boiler technology, specifically a pneumatic conveying system for CFB units and a CFB boiler using this system.

BACKGROUND

Coal-fired power dominates global electricity generation (>50% share), with CFB boilers for low-calorific coal gaining prominence due to resource efficiency.

Compared to pulverized coal boilers, CFB boilers exhibit high thermal inertia and strong coupling. Abundant bed materials and refractories store heat, slowing load response. Most CFB units achieve ≤1% Pe/min load change rates, inherently lagging pulverized coal units.

Mechanistically, the slow load response stems from delayed coal combustion. CFB boilers use larger coal particles (0.01-8 mm, median ~1.5 mm) and lower furnace temperatures, slowing burn rates. Additionally, dense-phase zone inert materials hinder oxygen diffusion, further reducing heat release rates and causing thermal lag. Thus, existing coal feed systems fail to meet rapid load-increasing demand.

INVENTION SUMMARY

The technical problem addressed by the present invention is to provide a novel pneumatic conveying system and CFB boiler, to improve the load-increasing rate of the CFB boiler.

To solve the above technical problem, according to one aspect of the invention, a pneumatic conveying system is provided, comprising:

A compressed air and coal powder mixing system, including an air compressor, a coal powder bin, a powder feeder, and an air-powder mixer. The powder feeder is installed at the bottom of the coal powder bin. The air compressor and powder feeder are respectively connected to the inlet of the air-powder mixer. The air compressor supplies compressed air to the air-powder mixer. The coal powder bin stores coal powder and feeds it into the air-powder mixer via the powder feeder. The air-powder mixer blends the compressed air and coal powder to output an air-powder mixture.

A conveying system for the air-powder mixture includes a main conveying pipe and branch conveying pipes.

The outlet of the air-powder mixer is connected to the main conveying pipe, which branches via a distributor to the inlets of multiple conveying pipes.

The branch conveying pipes include front-wall, rear-wall, and side-wall conveying pipes, each comprising multiple secondary air pipes and conveying pipes.

The conveying pipes are sleeve-connected to the secondary air pipes on the front, rear, and side walls of the CFB boiler, delivering the air-powder mixture into the furnace chamber.

A damper is connected to the inlet of the air compressor. The outlet of the air compressor is linked via a pipeline to the inlet of a refrigerated dryer, the outlet of which is connected to the inlet of an air storage tank. The compressed air outlet of the air storage tank is connected via a pipeline to the air-powder mixer.

Each conveying pipe in the branch conveying pipes is equipped with a manual slide gate and a discharge valve.

The front-wall conveying pipe includes upper and lower secondary air pipes and a front-wall conveying pipe, the outlet of which is fitted with a variable-section coal nozzle. The rear-wall conveying pipe includes upper and lower secondary air pipes and a rear-wall conveying pipe, the outlet of which is also fitted with a variable-section coal nozzle.

The inlet cross-section of the variable-section coal nozzle is circular with the same diameter as the front-wall and rear-wall conveying pipes, while the outlet cross-section is a hybrid shape composed of two semicircles and a central rectangle. The diameter ($D_2$) of each semicircle is (0.25-0.50) times the diameter ($D_1$) of the inlet circle.

The air-powder mixture velocity at the outlet of the variable-section coal nozzle reaches (24-42) m/s.

The side-wall conveying pipe includes upper and lower secondary air pipes and a side-wall conveying pipe, the outlet of which fitted with a tapered round coal nozzle.

The tapered round coal nozzle has a cone angle of (1-15)° and an outlet area (0.25-0.35) times the inlet area.

The air-powder mixture velocity at the outlet of the tapered round coal nozzle is (50-72) m/s.

According to another aspect of the invention, a CFB boiler is provided, which includes the aforementioned pneumatic conveying system.

The invention addresses the drawback of existing CFB boiler coal feeding systems, which are unsuitable for rapid load changes. By providing a novel pneumatic conveying system for CFB boilers, the invention increases the load change rate of CFB units from the current 1% Pe/min to over 3% Pe/min. Additionally, it reduces the ignition restart temperature, extends the ignition hold time, and ensures safe and rapid load increase for CFB units.

FIGURES

To describe the technical solutions in the embodiments of the present invention or in the prior art more clearly, the accompanying drawings required for the embodiments will be briefly described below. Apparently, the accompanying drawings in the following description show merely some embodiments of the present invention, and a person of ordinary skill in the art may still derive other accompanying drawings from these accompanying drawings without creative efforts.

Figure 3A:
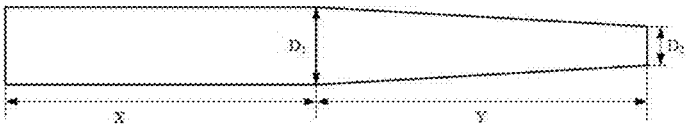
Figure 3B:
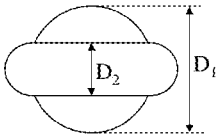

FIG. 3A is the front view of the conveying pipe and variable-section coal nozzle. FIG. 3B is the side view of the variable-section coal nozzle. X is pulverized coal pipe with a constant diameter. Y is the pulverized coal nozzle with variable cross-section.

Figure 4:
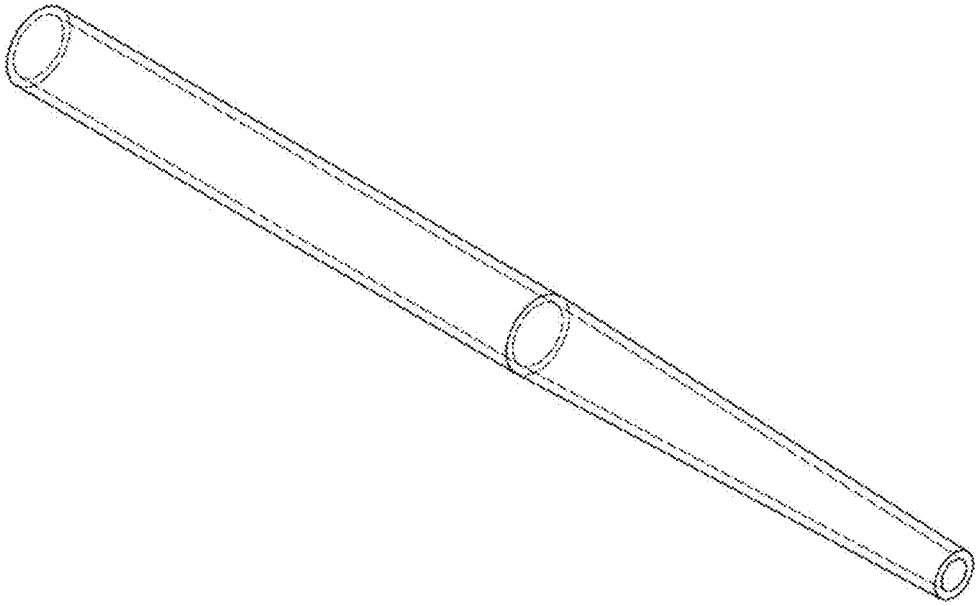

FIG. 4 is a three-dimensional structural diagram showing the round pulverized coal conveying pipe with a constant diameter and tapered pulverized coal nozzle.

Figure 5A:
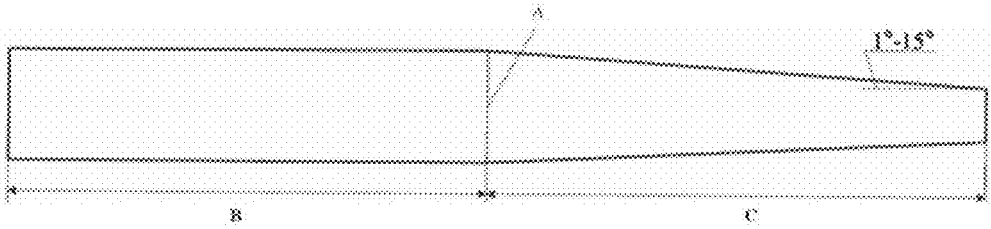
Figure 5B:
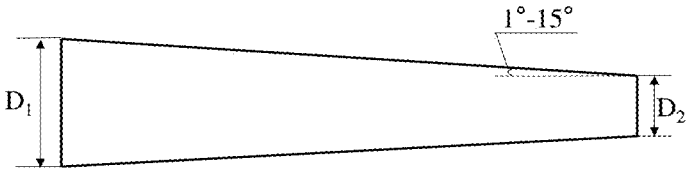
Figure 5C:
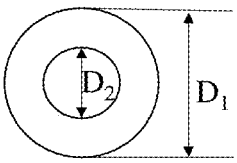

FIG. 5A illustrates the front view of the round pulverized coal conveying pipe with a constant diameter and tapered pulverized coal nozzle, where A, B, C are the weld seam, pulverized coal conveying pipe with a constant diameter and tapered pulverized coal nozzle, respectively. FIG. 5B is the front view of the tapered pulverized coal nozzle. FIG. 5C is the side view of the tapered pulverized coal nozzle.

Figure 1:
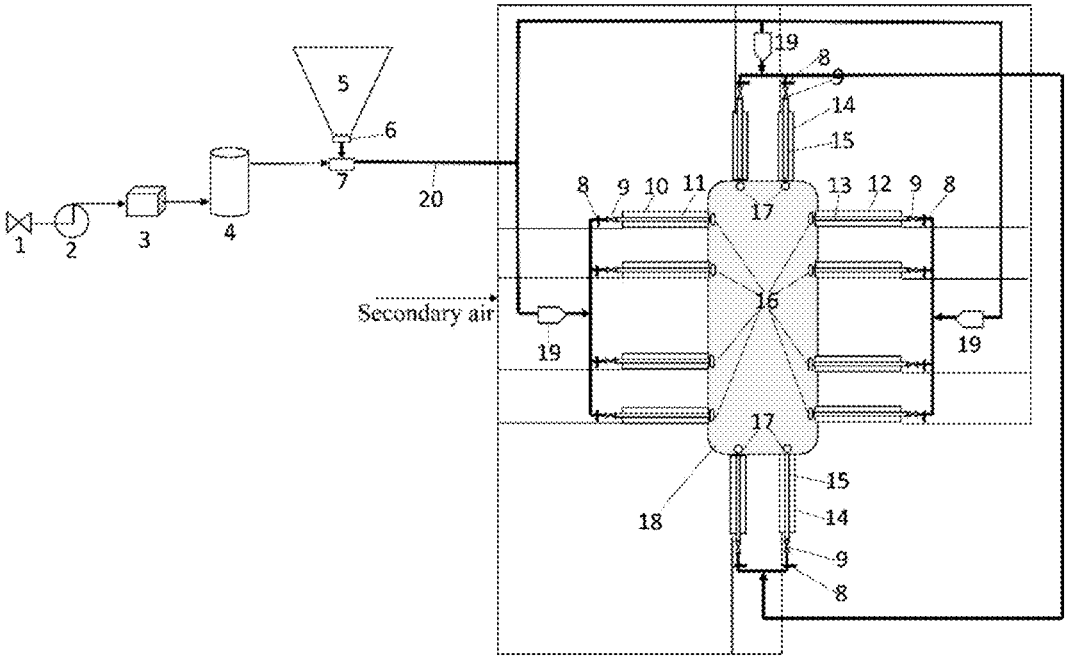
FIG. 1 is the schematic diagram showing the overall structure of the pneumatic conveying system and CFB boiler according to the present invention.

In the FIG. 1: 1—damper; 2—air compressor; 3—refrigerated dryer; 4—air storage tank; 5—coal powder bin; 6—powder feeder; 7—air-powder mixer; 8—manual slide gate; 9—discharge valve; 10—front-wall upper/lower secondary air pipe; 11—front-wall conveying pipe; 12—rear-wall upper/lower secondary air pipe; 13—rear-wall conveying pipe; 14—side-wall upper/lower secondary air pipe; 15—side-wall conveying pipe; 16—variable-section coal nozzle; 17—tapered round coal nozzle; 18—furnace chamber; 19—distributor; 20—main conveying pipe.

DETAILED DESCRIPTION OF EMBODIMENTS

Considering that fine coal powder (with particle size about 70-100 μm) burns extremely rapidly, completing combustion in just a few seconds, the basic concept of this invention is to couple a powder conveying system with the existing coal feeding system of a CFB boiler. The fine coal powder is delivered into the furnace through compressed air via the existing secondary air system, achieving well-organized combustion through opposed firing between front/rear walls and between side walls. The oxygen-rich environment at secondary airports enables rapid, large-area heat release from coal powder, addressing both the low combustion rate caused by large coal particle size and the slow combustion rate due to oxygen deficiency at coal feed ports.

Based on this concept, a typical embodiment of the CFB boiler's powder conveying system provided by this invention, as shown in FIG. 1, comprises two parts: a compressed air and coal powder mixing system, and an air-powder mixture conveying system.

The compressed air and coal powder mixing system includes: air compressor 2, coal powder bin 5, powder feeder 6, air-powder mixer 7. The powder feeder 6 is installed at the bottom of the coal powder bin 5. Both the air compressor 2 and powder feeder 6 are connected to the inlet of the air-powder mixer 7. The air compressor 2 supplies compressed air to the air-powder mixer 7, while the coal powder bin 5 stores coal powder and feeds it into the air-powder mixer 7 through the powder feeder 6. The air-powder mixer 7 mixes the compressed air with coal powder and outputs the air-powder mixture.

As a preferred embodiment, the air compressor 2 inlet relates to a damper 1, which regulates the air intake of the air compressor 2. The air compressor 2 outlet is connected via pipeline to the inlet of a refrigerated dryer 3, whose outlet is connected via pipeline to the inlet of an air storage tank 4. The compressed air outlet of the air storage tank 4 is connected via pipeline to the air-powder mixer 7. The refrigerated dryer 3 removes moisture from the air, and the air storage tank 4 serves as a container for stabilizing air pressure.

The compressed air from the air compressor 2 enters the air storage tank 4 after being dehumidified by the refrigerated dryer 3. The compressed air from the air storage tank 4 is delivered to the air-powder mixer 7 through pipelines. The coal powder from the coal powder bin 5 is fed into the air-powder mixer 7 by the powder feeder 6. The compressed air and coal powder are mixed in the air-powder mixer 7, which outputs an air-powder mixture with certain velocity and pressure head.

The air-powder mixture conveying system includes the main conveying pipe 20 and conveying pipelines. The conveying pipelines include front-wall conveying pipelines, rear-wall conveying pipelines and side-wall conveying pipelines. Each conveying pipeline includes multiple secondary air pipes and multiple conveying pipes to deliver the air-powder mixture into the furnace from the boiler's front wall, rear wall and side walls.

The conveying pipes are connected to the secondary air pipes on the front wall, rear wall and both side walls of the CFB boiler in a sleeve-type manner, delivering the air-powder mixture into the furnace chamber 18 of the CFB boiler.

The outlet of the air-powder mixer 7 is connected to the main conveying pipe 20, which is connected to the inlets of each conveying pipe through the distributor 19. The main conveying pipe 20 at the outlet of the air-powder mixer 7 splits into three paths: one connected to all conveying pipes on the front wall, one connected to all conveying pipes on the rear wall, and one connected to all conveying pipelines on both side walls.

In the preferred embodiment, each conveying pipe of the conveying pipelines is equipped with a manual slide gate 8 and a discharge valve 9 to control the feeding amount of the air-powder mixture.

As shown in FIG. 1, in a relatively specific embodiment, the front-wall conveying pipeline includes the front-wall upper and lower secondary air pipes 10 and the front-wall conveying pipe 11, with the outlet of the front-wall conveying pipe 11 connected to a coal nozzle. The rear-wall conveying pipeline includes the rear-wall upper and lower secondary air pipes 12 and the rear-wall conveying pipe 13, with the outlet of the rear-wall conveying pipe 13 connected to a coal nozzle. The side-wall conveying pipeline includes the side-wall upper and lower secondary air pipes 14 and the side-wall conveying pipe 15, with the outlet of the side-wall conveying pipe 15 connected to a coal nozzle.

The function of the coal nozzle is to inject the air-powder mixture into the furnace. The present invention provides two different types of coal nozzles: the variable-section coal nozzle 16 and the tapered round coal nozzle 17.

The outlets of the front-wall conveying pipe 11 and rear-wall conveying pipe 13 are connected to the variable-section coal nozzle 16, while the outlets of both side-wall conveying pipes 15 are connected to the tapered round coal nozzle 17.

Figure 2:
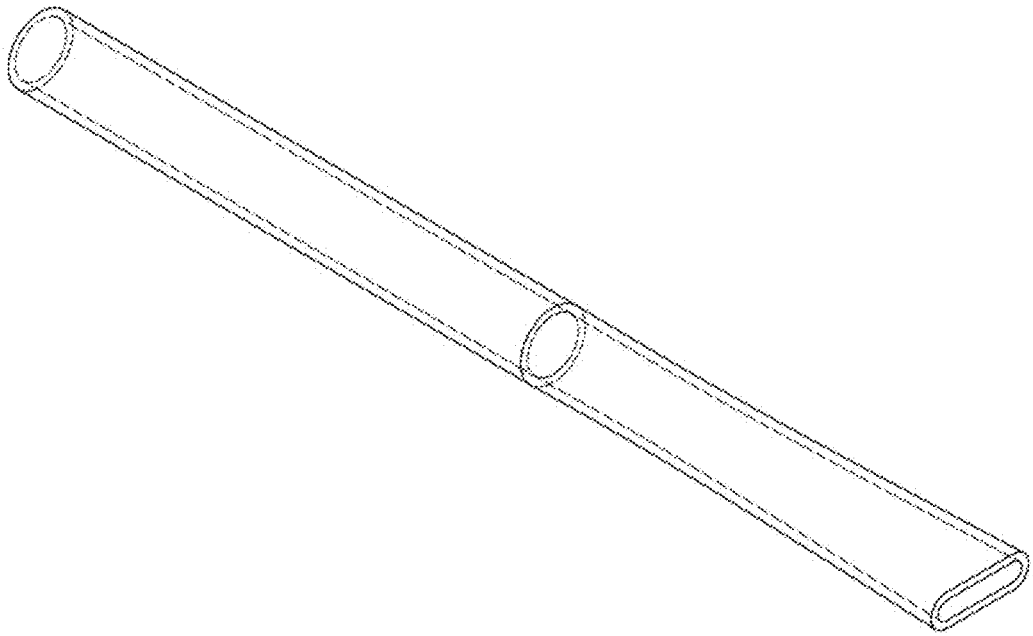
FIG. 2 is a three-dimensional structural diagram showing the conveying pipe and variable-section coal nozzle.

As shown in FIG. 2 and FIGS. 3A and 3B, the variable-section coal nozzle 16 and the conveying pipe form an integral forged structure. Its inlet cross-section is circular with the same diameter as the front-wall and rear-wall conveying pipes, while the outlet cross-section is a special shape composed of two semicircles on both sides and a rectangle in the middle. The diameter $D_2$ of the semicircles is (0.25-0.50) times the diameter $D_1$ of the inlet circle, enabling the air-powder flow velocity at the outlet of the variable-section coal nozzle 16 to reach (24-42) m/s.

As shown in FIG. 4 and FIGS. 5A-5C, the tapered round coal nozzle 17 has a cone angle θ of (1-15)°, with the outlet area being (0.25-0.35) times the inlet area, enabling the air-powder flow velocity at the outlet of the tapered round coal nozzle 17 to reach (50-72) m/s. The inlet of the tapered round coal nozzle 17 is welded to the conveying pipe.

The technical solutions claimed in the present invention will be further explained clearly and completely below in conjunction with some relatively specific examples.

Embodiment 1

This embodiment provides a CFB boiler that integrates the conveying system of the present invention with the existing coal feeding system of the CFB boiler. The conveying system includes a compressed air and coal powder mixing system and an air-powder mixture conveying system.

The compressed air and coal powder mixing system includes the damper 1, air compressor 2, refrigerated dryer 3, air storage tank 4, coal powder bin 5, powder feeder 6 and air-powder mixer 7.

The inlet of the air compressor 2 is connected to the damper 1. The outlet of the air compressor 2 is connected to the inlet of the refrigerated dryer 3 through pipelines. The outlet of the refrigerated dryer 3 is connected to the inlet of the air storage tank 4 through pipelines. The compressed air outlet of the air storage tank 4 is connected to the air-powder mixer 7 through pipelines. Powder feeder 6 is installed at the bottom of the coal powder bin 5 and connected to the air-powder mixer 7 through pipelines.

In the air-powder mixture conveying system, the main conveying pipe 20 is connected to the front-wall conveying pipeline, rear-wall conveying pipeline and side-wall conveying pipeline respectively through the distributor 19. Each conveying pipe of the conveying pipelines is equipped with a manual slide gate 8 and a discharge valve 9.

The front-wall conveying pipeline includes the front-wall lower secondary air pipe 10 and the front-wall conveying pipe 11, with the outlet of the front-wall conveying pipe 11 connected to the variable-section coal nozzle 16. The rear-wall conveying pipeline includes the rear-wall lower secondary air pipe 12 and the rear-wall conveying pipe 13, with the outlet of the rear-wall conveying pipe 13 connected to the variable-section coal nozzle 16.

In the above variable-section coal nozzle 16, the diameter $D_2$ of the semicircles is 0.4 times the diameter $D_1$ of the inlet circle, enabling the air-powder flow velocity at the outlet of the variable-section coal nozzle 16 to reach 28.1 m/s.

The side-wall conveying pipeline includes the side-wall upper secondary air pipe 14 and the side-wall conveying pipe 15, with the outlet of the side-wall conveying pipe 15 connected to the tapered round coal nozzle 17.

The above tapered round coal nozzle 17 has a cone angle of 10°, with the outlet area being 0.3 times the inlet area, enabling the air-powder flow velocity at the outlet of the tapered round coal nozzle 17 to reach 60 m/s.

Embodiment 2

The difference from embodiment 1 lies in: for the variable-section coal nozzle 16, the diameter $D_2$ of the semicircles is 0.25 times the diameter $D_1$ of the inlet circle, enabling the air-powder flow velocity at the outlet of the variable-section coal nozzle 16 to reach 42 m/s. The tapered round coal nozzle 17 has a cone angle of 1°, with the outlet area being 0.25 times the inlet area, enabling the air-powder flow velocity at the outlet of the tapered round coal nozzle 17 to reach 72 m/s.

Embodiment 3

The difference from Embodiment 1 lies in the tapered pulverized coal nozzle 16, whose semicircular diameter $D_2$ is 0.5 times the inlet circular diameter $D_1$, and the air-coal flow velocity at the outlet of the tapered pulverized coal nozzle 16 reaches 24 m/s. The conical angle of the convergent round pipe pulverized coal nozzle 17 is 15°, and the outlet area is 0.35 times the inlet area. The air-coal flow velocity at the outlet of the convergent round pipe pulverized coal nozzle 17 is 51.4 m/s.

Comparative Embodiment

Taking the load increase of a CFB unit from 35% Pe to 50% Pe as an example for analysis, in the existing coal feeding system, the CFB coal increases stepwise from 115 t/h to 151 t/h, with a load increase rate of 1% Pe/min. By coupling a pulverized coal delivery system according to the present invention, when the unit load increases from 35% Pe to 50% Pe, in addition to the CFB coal increasing stepwise from 115 t/h to 151 t/h, 7 t/h of pulverized coal is simultaneously delivered into the furnace. The dynamic heat input into the furnace increases by 40%, and the load increase rate can exceed 3% Pe/min.

The scope of protection claimed by the present invention is not limited to the above specific embodiments. For those skilled in the art, the present invention may have various modifications and changes. Any amendments, improvements, or equivalent replacements made within the concept and principles of the present invention shall be included within the protection scope of the present invention.

What is claimed is:

1. A pneumatic conveying system, characterized by comprising:

a compressed air and coal powder mixing system, including an air compressor, a coal powder bin, a powder feeder, and an air-powder mixer, the powder feeder is located at the bottom of the coal powder bin, the air compressor and powder feeder are connected to an inlet of the air-powder mixer, the air compressor supplies compressed air to the mixer, the coal powder bin stores coal powder and feeds the coal powder to the mixer via the powder feeder, and the mixer blends the air and powder to output an air-powder mixture, the air compressor inlet is connected to a damper, the air compressor outlet is linked via pipes to a refrigerated dryer, an outlet of the refrigerated dryer connects to an air storage tank, an outlet of the air storage tank supplies compressed air to the air-powder mixer, a conveying system for the air-powder mixture, including a main conveying pipe and branch pipes, the mixer outlet connects to the main conveying pipe, the main conveying pipe branches via a distributor to multiple conveying pipes, the branch pipes include front-wall, rear-wall, and side-wall pipes, each comprising multiple secondary air pipes and conveying pipes, and each conveying pipe is equipped with a manual slide gate and a discharge valve, the conveying pipes are sleeve connected to secondary air pipes on front, rear, and side walls of a boiler, delivering the air-powder mixture into a furnace chamber, the front-wall pipe includes upper and/or lower secondary air pipes and a conveying pipe, with an outlet of the conveying pipe fitted with a variable-section coal nozzle, the rear-wall pipe includes upper and/or lower secondary air pipes and a conveying pipe, also with a variable-section nozzle, an outlet of the variable-section coal nozzle comprises two semicircles, wherein the diameter ($D_2$) of each semicircle is 0.25-0.5 times the inlet circular diameter ($D_1$) of the variable-section coal nozzle, an outlet velocity of the air-powder mixture from the variable-section coal nozzle ranges from 24-42 m/s, the side-wall pipe includes upper and/or lower secondary air pipes and a conveying pipe, with a tapered round nozzle at an outlet of the conveying pipe, the tapered round nozzle has a cone angle of 1-15° and an outlet area of 0.25-0.35 times the inlet area, achieving an outlet velocity of the air-powder mixture of 50-72 m/s.

2. A circulating fluidized bed (CFB) boiler, comprising the pneumatic conveying system according to claim 1.

* * * * *